US009046029B2

(12) United States Patent
Kawabata et al.

(10) Patent No.: US 9,046,029 B2
(45) Date of Patent: Jun. 2, 2015

(54) HEAT-RESISTANT, FERRITIC CAST STEEL HAVING EXCELLENT MELT FLOWABILITY, GAS DEFECT RESISTANCE, TOUGHNESS AND MACHINABILITY, AND EXHAUST MEMBER MADE THEREOF

(75) Inventors: Masahide Kawabata, Moka (JP); Hideo Kuribayashi, Miyako-gun (JP); Junji Hayakawa, Miyako-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 13/877,104

(22) PCT Filed: Oct. 3, 2011

(86) PCT No.: PCT/JP2011/072811

§ 371 (c)(1),
(2), (4) Date: Mar. 29, 2013

(87) PCT Pub. No.: WO2012/043860

PCT Pub. Date: Apr. 5, 2012

(65) Prior Publication Data

US 2013/0195713 A1 Aug. 1, 2013

(30) Foreign Application Priority Data

Oct. 1, 2010 (JP) ..... 2010-223366
Apr. 1, 2011 (JP) ..... 2011-082167

(51) Int. Cl.

| | |
|---|---|
| ***F01N 13/16*** | (2010.01) |
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/48*** | (2006.01) |

(52) U.S. Cl.

CPC ..... *F01N 13/16* (2013.01); *C22C 38/60* (2013.01); *C22C 38/001* (2013.01); *C22C 38/02* (2013.01); *C22C 38/04* (2013.01); *C22C 38/44* (2013.01); *C22C 38/48* (2013.01); *C21D 2211/004* (2013.01); *C21D 2211/005* (2013.01); *F01N 2530/04* (2013.01)

(58) Field of Classification Search

CPC ..... C22C 38/00; C22C 38/02; C22C 38/04; C22C 38/48; C22C 38/60; F01N 2530/04
USPC ..... 420/42
See application file for complete search history.

(56) References Cited

U.S. PATENT DOCUMENTS

| | | | | |
|---|---|---|---|---|
| 5,582,657 | A | 12/1996 | Watanabe et al. | |
| 2007/0215252 | A1 | 9/2007 | Takabayashi et al. | |
| 2011/0132499 | A1* | 6/2011 | Yamanaka et al. | 148/325 |

FOREIGN PATENT DOCUMENTS

| | | | | |
|---|---|---|---|---|
| JP | 05-320830 | A | 12/1993 | |
| JP | 07-197209 | A | 8/1995 | |
| JP | 07197209 | A * | 8/1995 | C22C 38/00 |

(Continued)

*Primary Examiner* — Kaj K Olsen
*Assistant Examiner* — Alexander Polyansky
(74) *Attorney, Agent, or Firm* — Sughrue Mion, PLLC

(57) ABSTRACT

A heat-resistant, ferritic cast steel having excellent melt flowability, gas defect resistance, toughness and machinability, which has a composition comprising by mass, C: 0.32-0.45%, Si: 0.85% or less, Mn: 0.15-2%, Ni: 1.5% or less, Cr: 16-23%, Nb: 3.2-4.5%, Nb/C: 9-11.5, N: 0.15% or less, S: (Nb/20–0.1) to 0.2%, W and/or Mo: 3.2% or less in total (W+Mo), the balance being Fe and inevitable impurities, and a structure in which the area ratio of a eutectic (δ+NbC) phase of δ ferrite and Nb carbide (NbC) is 60-80%, and the area ratio of manganese chromium sulfide (MnCr)S is 0.2-1.2%, and an exhaust member made thereof.

4 Claims, 1 Drawing Sheet

(56) References Cited

FOREIGN PATENT DOCUMENTS

| | | | | |
|---|---|---|---|---|
| JP | 11061343 A | * | 3/1999 | ..... C22C 38/00 |
| JP | 2000-204946 A | | 7/2000 | |
| JP | 2004-332021 A | | 11/2004 | |
| JP | 2007-254885 A | | 10/2007 | |

* cited by examiner

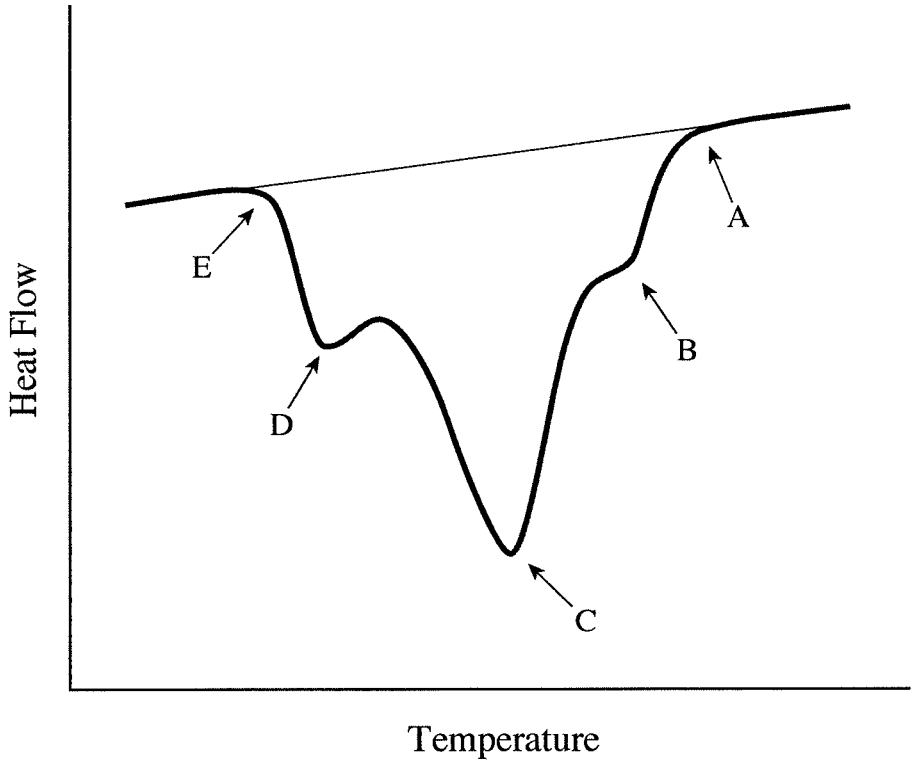
Heat Flow
Temperature
A
B
C
D
E

HEAT-RESISTANT, FERRITIC CAST STEEL HAVING EXCELLENT MELT FLOWABILITY, GAS DEFECT RESISTANCE, TOUGHNESS AND MACHINABILITY, AND EXHAUST MEMBER MADE THEREOF

FIELD OF THE INVENTION

The present invention relates to a heat-resistant, ferritic cast steel having excellent melt flowability, gas defect resistance, toughness and machinability and suitable for exhaust members, particularly exhaust manifolds, turbine housings, etc. for gasoline engines and diesel engines of automobiles, and an exhaust member made thereof.

BACKGROUND OF THE INVENTION

To prevent global warming, there is strong demand for the reduction of the amount of $CO_2$ discharged from automobiles. To reduce the amount of a $CO_2$ gas emitted, it is mainly necessary to improve the fuel efficiency of automobiles. Technologies for improving fuel efficiency include fuel direct injection, increase in compression ratios, the reduction (downsizing) of engine weights and sizes by supercharging, increase in the boost pressure of turbochargers, etc. With these technologies introduced, fuel combustion tends to occur at higher temperatures and higher pressure in automobile engines, so that the temperatures of exhaust gases discharged from engines are elevated to nearly 1000° C., and that the temperatures of exhaust members such as exhaust manifolds, catalyst cases, turbine housings, etc. reach about 900° C. Exhaust members exposed to such high-temperature exhaust gases are required to have excellent heat resistance properties (oxidation resistance, high-temperature strength, thermal deformation resistance and thermal cracking resistance).

Exhaust members such as manifolds, etc. of automobiles used under severe conditions at high temperatures have conventionally been made of heat-resistant cast irons such as high-Si, spheroidal graphite cast iron, Ni-Resist cast iron (austenitic, cast Ni—Cr iron), etc., heat-resistant, ferritic cast steels, heat-resistant, austenitic cast steels, etc.

Among conventional heat-resistant cast irons and heat-resistant cast steels, ferritic, spheroidal graphite cast iron containing 4% Si and 0.5% Mo exhibits better heat resistance properties up to about 800° C., but poor durability at higher temperatures. Heat-resistant cast irons such as Ni-Resist cast iron, etc. containing large amounts of rare metals such as Ni, Cr, Co, etc., and heat-resistant, austenitic cast steels are used for exhaust members, because they meet both requirements of oxidation resistance and thermal cracking resistance at 800° C. or higher.

However, the Ni-Resist cast iron contains a large amount of expensive Ni, and has poor thermal cracking resistance because it has a large coefficient of linear expansion due to an austenitic matrix structure, and because its microstructure contains graphite acting as the starting points of fracture. The heat-resistant, austenitic cast steel has insufficient thermal cracking resistance at about 900° C. because of a large coefficient of linear expansion, though not containing graphite acting as the starting points of fracture. In addition, the heat-resistant, austenitic cast steel is expensive and thus has cost disadvantages because it contains large amounts of rare metals, and suffers unstable material supply affected by world economic situations.

From the aspect of economic feasibility, stable material supply and efficient use of global resources, it is desirable that heat-resistant materials used for exhaust members have necessary heat resistance properties with the minimum amounts of rare metals. Thus provided are inexpensive exhaust members, which enable the application of fuel-efficiency-improving technologies to popular cars, contributing to reducing the amount of a $CO_2$ gas emitted. To reduce the amounts of rare metals contained as much as possible, the matrix structures of alloys are advantageously ferrite rather than austenite. In addition, because ferritic materials have smaller coefficients of linear expansion than those of austenitic materials, the ferritic materials have better thermal cracking resistance because of smaller thermal stress generated at the start and acceleration of engines.

However, general ferritic cast steels contain as little C as about 0.2% or less by mass, and do not contain melting-point-lowering alloying elements such as Ni, etc. unlike austenitic cast steels, having high melting points. Accordingly, general ferritic cast steels have low flowability of melts (hereinafter referred to as "melt flowability"), poor castability, so that they likely suffer casting defects such as misrun, cold shut, shrinkage cavity, etc. during casting. Particularly exhaust members having complicated and/or thin shapes do not have good melt flowability with a small C content, suffering casting defects such as misrun, cold shut, etc., resulting in a low production yield. Further, unlike the austenitic cast steels, the ferritic cast steels contain substantially no interstitial solute elements, easily subject to gas defects by hydrogen. Incidentally, the gas defects are defects generated by hydrogen contained in a melt, which does not keep dissolved not only in the melt (liquid phase) but also in a solid phase as the melt temperature lowers during casting, thereby leaving vacancies in the solidified castings.

To provide the improvement of castability, etc., the applicant proposed by JP 7-197209 A, a heat-resistant, ferritic cast steel having excellent castability, which has a composition comprising by weight C, 0.15-1.20%, C—Nb/8: 0.05-0.45%, Si: 2% or less, Mn: 2% or less, Cr: 16.0-25.0%, W and/or Mo: 1.0-5.0%, Nb: 0.40-6.0%, Ni: 0.1-2.0%, and N, 0.01-0.15%, the balance being Fe and inevitable impurities, and having an ($\alpha$+carbide) phase (hereinafter referred to as "$\alpha'$ phase") transformed from a $\gamma$ phase (austenite phase), in addition to a usual $\alpha$ phase ($\alpha$ ferrite phase), the area ratio of the $\alpha'$ phase [$\alpha'/(\alpha+\alpha')$] being 20-70%. Because this heat-resistant, ferritic cast steel has excellent heat resistance properties at 900° C. or higher, it is suitable for exhaust members. Also, because it contains a large amount of C, it has good melt flowability, and thus improved castability.

In the heat-resistant, ferritic cast steel of JP 7-197209 A containing C in an amount more than consumed by forming NbC, carbide of Nb and C, C (austenitizing element) is dissolved in the matrix structure to form a solid solution, and forms a $\gamma$ phase at high temperatures during solidification, the $\gamma$ phase being transformed to an $\alpha'$ phase during a cooling process to room temperature, thereby improving ductility and oxidation resistance. In an as-cast state, however, the $\gamma$ phase is not transformed to the $\alpha'$ phase sufficiently, but to martensite. The high-hardness martensite extremely deteriorates toughness and machinability at room temperature. To obtain good toughness and machinability, a heat treatment for precipitating the $\alpha'$ phase while erasing martensite is necessary, but the heat treatment increases a production cost, providing economic disadvantages. The heat treatment also needs much energy, disadvantageous in the reduction of energy consumption.

As a cast member of ferritic, cast, stainless steel having a larger C content than those of general ferritic cast steels, JP 2007-254885 A discloses a thin casting member having improved high-temperature strength, which is made of ferritic, cast, stainless steel comprising C, 0.10-0.50% by mass, Si: 1.00-4.00% by mass, Mn: 0.10-3.00% by mass, Cr: 8.0-30.0% by mass, and Nb and/or V: 0.1-5.0% by mass in total, and has thin portions having thickness of 1-5 mm, a ferrite phase in the structure of thin portions having an average crystal grain size of 50-400 μm. In the cast member of JP 2007-254885 A made of ferritic, cast, stainless steel, thin portions of 5 mm or less are rapidly cooled after casting to reduce the average crystal grain size of the ferrite phase, thereby improving high-temperature yield strength, tensile strength and fracture elongation in thin portions.

However, in exhaust members having thick portions of 5 mm or more such as cylinder-head-mounting flanges, heat-insulation-plate-mounting bosses, bolt-fastening portions, thick converging portions, etc., the melt has a low cooling speed even in thin portions of 5 mm or less such as those near risers for preventing shrinkage cavities, and those adjacent to cavities where sand molds tend to be overheated. Such portions in the exhaust members have large average crystal grain sizes, resulting in low toughness (particularly room-temperature toughness). JP 2007-254885 A fails to disclose a measure for suppressing toughness decrease due to shape and thickness variations, casting designs, etc.

Also, the ferritic, cast, stainless steel of JP 2007-254885 A has improved melt flowability, which is obtained by lowering its melting point by containing Si in as large an amount as 1.00-4.00% by mass (about 2% or more in Examples), and improved high-temperature strength, oxidation resistance, carburizing resistance and machinability. However, this ferritic, cast, stainless steel has poor room-temperature toughness because it contains a large amount of Si dissolved in a ferritic matrix structure. Because Si dissolved in the ferritic matrix structure lowers the solid solution limit of hydrogen, a large amount of hydrogen is generated during solidification, accelerating the generation of gas defects.

Also, as a heat-resistant, ferritic cast steel having a larger C content than those of general ferritic cast steels, the applicant proposed by JP 11-61343 A, a heat-resistant, ferritic cast steel having excellent high-temperature strength (particularly creep rupture strength), which has a composition comprising by weight, C, 0.05-1.00%, Si: 2% or less, Mn: 2% or less, Cr: 16.0-25.0%, Nb: 4.0-20.0%, W and/or Mo: 1.0-5.0%, Ni: 0.1-2.0%, and N, 0.01-0.15%, the balance being Fe and inevitable impurities, and has a Laves phase ($Fe_2M$) in addition to a usual α phase. Though this heat-resistant, ferritic cast steel has excellent high-temperature strength and good melt flowability, it has been found that it suffers the generation of gas defects extremely when it contains a large amount of Nb. Accordingly, this heat-resistant, ferritic cast steel has not been put into practical use for exhaust members so far.

As described above, because conventional heat-resistant, ferritic cast steels have poor toughness and machinability despite good melt flowability, and are likely to have gas defects, they are not necessarily suitable for exhaust members. The toughness and machinability can be improved by a heat treatment, but the heat treatment increases a production cost. Because gas defects cannot easily be removed, cast members with gas defects have to be discarded as defective products, resulting in a low production yield.

OBJECTS OF THE INVENTION

Accordingly, an object of the present invention is to provide a heat-resistant, ferritic cast steel having excellent melt flowability, gas defect resistance, toughness and machinability, as well as high heat resistance properties such as oxidation resistance, high-temperature strength, thermal deformation resistance, thermal cracking resistance, etc. at about 900° C.

Another object of the present invention is to provide an exhaust member made of such heat-resistant, ferritic cast steel, such as exhaust manifolds, turbine housings, etc. for automobiles.

DISCLOSURE OF THE INVENTION

In view of the above object, a heat-resistant, ferritic cast steel containing 15-20% by mass of Cr has been used as a basic composition to investigate the relation between heat resistance properties, melt flowability, gas defect resistance, toughness and machinability and alloying elements, a composition range, a metal structure (microstructure) and a solidification mode. As a result, the following has been found. The present invention has been completed based on such discoveries.

(1) When thin castings having complicated shapes such as exhaust members are produced, casting materials are required to have good flowability. To improve the melt flowability, it is known that the addition of more C to lower the solidification start temperatures is effective, but the mere addition of more C deteriorates not only toughness by increase in the amount of Cr carbide precipitated, but also toughness and machinability by the crystallization of a γ phase transformed to martensite. However, the inventor has found that the increase of both C and Nb improves the melt flowability by lowering the solidification start temperature of cast steel, while suppressing decrease in toughness and machinability. With the same amount of C, a larger Nb content provides a lower solidification start temperature. The lowering of the solidification start temperature of cast steel is due to the fact that increase in Nb lowers the solidification start temperature of a primary δ phase (δ ferrite phase).

(2) In general, the dissolving of strength-improving alloying elements in a matrix structure or the formation of crystallized or precipitated phases decreases the toughness. It has been expected that even in the heat-resistant, ferritic cast steel of the present invention, the addition of large amounts of C and Nb extremely lowers its toughness due to increase in carbides, but the toughness has rather been improved drastically. The reason therefor is that because increase in C and Nb leads to the lowering of the solidification start temperature of a primary δ phase to near the solidification temperature range of a eutectic (δ+NbC) phase, the growth of crystal grains of the primary δ phase and the growth of crystal grains of the eutectic (δ+NbC) phase are suppressed by each other. Finer crystal grains improve the toughness. The amounts of crystal grains of the primary δ phase and crystal grains of the eutectic (δ+NbC) phase should be controlled to make these crystal grains finer. For this purpose, the amounts of C and Nb added should be adjusted.

(3) To prevent the crystallization of the γ phase harmful to the toughness, and to suppress Nb from being dissolved in the δ phase, in addition to making finer crystal grains of the primary δ phase and crystal grains of the eutectic (δ+NbC) phase, a balance of the C content and the Nb content is important. It has been found that with a ratio (Nb/C) of Nb to C limited to a desired range, excessive C is crystallized as Nb carbide (NbC), C and Nb are not substantially dissolved in the ferritic matrix structure, and the γ phase is not crystallized with minimum Nb dissolved in the δ phase, thereby suppressing the deterioration of toughness and machinability.

(4) More Nb lowers the solidification start temperature of the primary δ phase to improve melt flowability, but increases gas defects. The reason why more Nb provides more gas defects is that the crystallization of the primary δ phase decreases gradually, while the eutectic (δ+NbC) phase having a narrow solidification temperature range increases gradually, resulting in a narrower solidification temperature range of the melt. Because the solid solution limit of hydrogen in a solid phase is much smaller than the solubility of hydrogen in a liquid phase, hydrogen is discharged from the solid phase to the liquid phase during solidification. With a wider solidification temperature range, more hydrogen can move from the solid phase to the liquid phase through a solid-liquid phase, and finally escape into the air through a permeable casting mold. However, it is presumed that with a narrow solidification temperature range, the rapid disappearing of the liquid phase makes it impossible for hydrogen to escape sufficiently, so that hydrogen trapped in castings causes gas defects. Accordingly, the upper limit of the Nb content should be limited to suppress gas defects.

(5) As a method for expanding the solidification temperature range to suppress gas defects, (a) a method of lowering the crystallization temperature of a eutectic (δ+NbC) phase, (b) a method of elevating the crystallization temperature of a primary δ phase, and (c) a method of crystallizing another phase than the eutectic (δ+NbC) phase after the crystallization of the eutectic (δ+NbC) phase have been investigated. The method (a) needs drastic changes of the types and amounts of alloying elements, deviating from the heat-resistant, ferritic cast steel containing 15-20% Cr. The method (b) is possible by reducing the amounts of C and Nb, but deteriorates the melt flowability by the elevation of the solidification start temperature. Accordingly, the methods (a) and (b) are not suitable for the object of the present invention.

In the investigation of the method (c) of crystallizing another phase after the crystallization of the eutectic (δ+NbC) phase, the solidification process of the heat-resistant, ferritic cast steel of JP 7-197209 A having good gas defect resistance has been researched by differential scanning calorimetry (DSC). As a result, it has been found that after the primary δ phase and the eutectic (δ+NbC) phase are crystallized successively, the γ phase is crystallized, and solidification is then terminated, providing a wide solidification temperature range. It is presumed from this result that the heat-resistant, ferritic cast steel of JP 7-197209 A has a wide solidification temperature range by the γ phase crystallized after the crystallization of the eutectic (δ+NbC) phase, resulting in improved gas defect resistance. Because the γ phase deteriorates toughness and machinability, investigation has been conducted on alloying elements that crystallize α phase not deteriorating toughness and machinability in place of the γ phase after the crystallization of the eutectic (δ+NbC) phase. As a result, it has been found that manganese chromium sulfide (MnCr)S, Cr-dissolved sulfide, is crystallized after the crystallization of the eutectic (δ+NbC) phase by containing a proper amount of S, lowering the solidification-terminating temperature and expanding the solidification temperature range, and thus providing good gas defect resistance.

(6) A larger amount of the eutectic (δ+NbC) phase is crystallized as the Nb content increases, resulting in a larger amount of hydrogen discharged from a solid phase to a liquid phase, thereby increasing gas defects. To cause more hydrogen to escape from the material into the air, a solid-liquid phase providing paths permitting hydrogen to escape should be increased. Because a larger amount of manganese chromium sulfide (MnCr)S crystallized in a late stage of solidification increases the solid-liquid phase, a larger S content is preferable. Also, the amount of hydrogen discharged can be reduced by reducing the amount of Nb in a range having enough melt flowability and toughness, resulting in a decreased S content. Accordingly, to improve the gas defect resistance, the S content should be adjusted (increased or decreased) depending on the Nb content.

(7) When too much S is added to improve the gas defect resistance, the toughness tends to be deteriorated. Accordingly, the upper limit of the S content should be restricted while avoiding the deterioration of toughness.

The solidification process of the heat-resistant, ferritic cast steel of the present invention determined by differential scanning calorimetry (DSC) is schematically shown in FIG. 1. After solidification starts at a point A, the primary δ phase is first crystallized (point B), the eutectic (δ+NbC) phase is then crystallized (point C), and manganese chromium sulfide (MnCr)S is finally crystallized (point D), with solidification terminating at a point E. In the heat-resistant, ferritic cast steel of the present invention, manganese chromium sulfide (MnCr)S is crystallized during a later stage of solidification after the crystallization of the eutectic (δ+NbC) phase, lowering the solidification-terminating temperature and thus expanding the solidification temperature range. As a result, a solid-liquid phase providing paths permitting hydrogen to escape increases, resulting in improved gas defect resistance.

The heat-resistant, ferritic cast steel of the present invention having excellent melt flowability, gas defect resistance, toughness and machinability has a composition comprising by mass C: 0.32-0.45%,
Si: 0.85% or less,
Mn: 0.15-2%,
Ni: 1.5% or less,
Cr: 16-23%,
Nb: 3.2-4.5%,
Nb/C: 9-11.5,
N: 0.15% or less,
S: (Nb/20−0.1) to 0.2%, and
W and/or Mo: 3.2% or less in total (W+Mo),
the balance being Fe and inevitable impurities, and has a structure in which the area ratio of a eutectic (δ+NbC) phase of a δ phase and a Nb carbide (NbC) is 60-80%, and the area ratio of manganese chromium sulfide (MnCr)S is 0.2-1.2%.

The exhaust member of the present invention is formed by the above heat-resistant, ferritic cast steel. Specific examples of the exhaust members include an exhaust manifold, a turbine housing, an exhaust manifold integral with a turbine housing, a catalyst case, an exhaust manifold integral with a catalyst case, and an exhaust outlet.

BRIEF DESCRIPTION OF THE DRAWINGS

FIG. 1 is graph showing the thermal analysis results of the heat-resistant, ferritic cast steel by differential scanning calorimetry (DSC).

DESCRIPTION OF THE PREFERRED EMBODIMENTS

[1] Heat-Resistant, Ferritic Cast Steel

The composition and structure of the heat-resistant, ferritic cast steel of the present invention will be explained in detail below. The amount of each alloying element is expressed by "% by mass" unless otherwise mentioned.

(A) Composition (1) C (Carbon): 0.32-0.45%

C lowers the solidification start temperature to improve the flowability (castability) of a melt, and a primary δ phase further lowers the solidification start temperature to improve the melt flowability. To secure the melt flowability, one of important properties for producing thin castings with complicated shapes such as exhaust members, the solidification start temperature is desirably lower than about 1440° C. To have such a low solidification start temperature, the heat-resistant, ferritic cast steel of the present invention should contain 0.32% or more of C. However, when the C content exceeds 0.45%, a eutectic (δ+NbC) phase of a δ phase and Nb carbide is formed excessively to provide embrittlement, resulting in low room-temperature toughness. Accordingly, the C content is 0.32-0.45%. The C content is preferably 0.32-0.44%, more preferably 0.32-0.42%, most preferably 0.34-0.40%.

(2) Si (Silicon): 0.85% or Less

Si functions as a deoxidizer for the melt, and improves the oxidation resistance. However, when Si exceeds 0.85%, Si is dissolved in the ferritic matrix structure to form a solid solution, making the matrix structure extremely brittle, and lowering the solid solution limit of hydrogen in ferrite, thereby providing the heat-resistant, ferritic cast steel with poor resistance to gas defects. Accordingly, the Si content is 0.85% or less (not including 0%). The Si content is preferably 0.2-0.85%, more preferably 0.3-0.85%, most preferably 0.3-0.6%.

(3) Mn (manganese): 0.15-2%

Mn is an element functioning as a deoxidizer for the melt like Si, and effective for securing the gas defect resistance. Mn is combined with Cr and S in the final phase of solidification to form manganese chromium sulfide (MnCr)S, which acts as paths for hydrogen to escape outside, contributing to improving the gas defect resistance, though its details will be described later. To form (MnCr)S, Mn should be at least 0.15%. However, more than 2% of Mn deteriorates the oxidation resistance and toughness of the heat-resistant, ferritic cast steel. Accordingly, the Mn content is 0.15-2%. The Mn content is preferably 0.15-1.85%, more preferably 0.15-1.25%, most preferably 0.15-1.0%.

(4) Ni (Nickel): 1.5% or Less

Ni is an austenite-stabilizing element, which forms a γ phase. The austenite is transformed to martensite, which extremely deteriorates toughness and machinability, during cooling to room temperature. The Ni content is thus desirably as little as possible. However, because Ni is contained in stainless steel scraps, starting materials, it is highly likely contained as an inevitable impurity in the heat-resistant, ferritic cast steel. The upper limit of the Ni content having substantially no adverse effects on toughness and machinability is 1.5%. Accordingly, the Ni content is 1.5% or less (including 0%). The Ni content is preferably 0-1.25%, more preferably 0-1.0%, most preferably 0-0.9%.

(5) Cr (Chromium): 16-23%

Cr is an element improving the oxidation resistance and stabilizing the ferrite structure. To have high oxidation resistance at about 900° C., Cr should be at least 16%. Also, Cr is combined with Mn and S to form manganese chromium sulfide (MnCr)S, which acts as paths for hydrogen to escape outside, contributing to improving the gas defect resistance. However, when Cr exceeds 23%, sigma embrittlement likely occurs, resulting in extremely deteriorated toughness and machinability. Accordingly, the Cr content is 16-23%. The Cr content is preferably 17-23%, more preferably 17-22.5%, most preferably 17.5-22%.

(6) Nb (Niobium): 3.2-4.5%

Nb has a strong capability of forming carbide. Nb is combined with C to form carbide (NbC) during solidification, thereby preventing C, a strong austenite-stabilizing element, from being dissolved in the ferritic matrix structure to form a solid solution. Thus, the crystallization of a γ phase lowering toughness and machinability is prevented. The formation of the eutectic (δ+NbC) phase improves the high-temperature strength. Further, Nb lowers the solidification start temperature, keeping good melt flowability. In addition, Nb makes crystal grains of the primary δ phase and crystal grains of the eutectic (δ+NbC) phase finer, improving the toughness remarkably. To exhibit such function, the Nb content should be 3.2% or more.

However, the eutectic (δ+NbC) phase has as narrow a solidification temperature range as about 30° C., so that it is rapidly solidified. Increase in the Nb content leads to increase in the amount of eutectic (δ+NbC) phase having a narrow solidification temperature range, narrowing the solidification temperature range. In addition, lowering the solidification start temperature of the primary δ phase contributes to narrowing the solidification temperature range. In sum, the solidification temperature range is drastically narrowed by increase in the Nb content, which leads to (a) lowering the solidification start temperature of the primary δ phase, and (b) increasing the amount of eutectic (δ+NbC) phase having a narrow solidification temperature range.

When Nb exceeds 4.5%, hydrogen discharged from a liquid phase during solidification tends to be less escapable as the solidification temperature range becomes narrower, resulting in more gas defects and thus remarkably lowered gas defect resistance. When the Nb content exceeds 4.5%, the eutectic (δ+NbC) phase is formed excessively, making the heat-resistant, ferritic cast steel brittle. Further, when Nb exceeds 5.0%, the primary δ phase is not crystallized anymore, but only the eutectic (δ+NbC) phase is crystallized, terminating the solidification in as narrow a solidification temperature range as about 30° C. in a short period of time. This substantially hinders hydrogen discharged from the liquid phase from escaping outside, extremely generating gas defects. Accordingly, the Nb content is 3.2-4.5%. The Nb content is preferably 3.3-4.4%, more preferably 3.4-4.2%, most preferably 3.4-4.0%.

(7) Nb/C: 9-11.5

The limitation of the content ratio (Nb/C) of Nb to C to a particular range is the most important requirement for providing the heat-resistant, ferritic cast steel of the present invention with well-balanced properties. When C is excessive, namely when Nb/C is too small, excessive C not combined with Nb is dissolved in the matrix structure to form a solid solution, resulting in an unstable δ phase and a crystallized γ phase. The crystallized γ phase is transformed to martensite, which lowers toughness and machinability, until reaching room temperature. Also, when Nb/C is too small, the primary δ phase is crystallized excessively, and its growth is accelerated, failing to obtain fine crystal grains of the primary δ phase, and thus failing to improve the toughness. To suppress the amount of the γ phase crystallized, and to make crystal grains of the primary δ phase and crystal grains of the eutectic (δ+NbC) phase finer, Nb/C should be 9 or more.

On the other hand, when Nb is excessive, namely when Nb/C is too large, Nb is dissolved in the δ phase to form a solid solution, giving lattice strain to the δ phase, and thus lowering the toughness of the δ phase. Also, when Nb/C is too large, the eutectic (δ+NbC) phase is crystallized excessively, and its growth is accelerated, failing to obtain fully fine crystal grains of the eutectic (δ+NbC) phase, and thus failing to improve the toughness. To suppress Nb from being dissolved in the δ phase, and to make crystal grains of the primary δ phase and crystal grains of the eutectic (δ+NbC) phase finer, Nb/C should be 11.5 or less. Thus, Nb/C is 9-11.5. Nb/C is preferably 9-11.3, more preferably 9.3-11, most preferably 9.5-10.5.

(8) N (Nitrogen): 0.15% or Less

N is a strong austenite-stabilizing element, forming the γ phase. The formed γ phase is transformed to martensite until cooled to room temperature, deteriorating the toughness and machinability. Accordingly, the N content is desirably as small as possible. However, because N is contained in molten materials (scraps), it exists in the cast steel as an inevitable impurity. Because the upper limit of N not substantially deteriorating the toughness and machinability is 0.15%, the N content is 0.15% or less (including 0%). The N content is preferably 0-0.13%, more preferably 0-0.11%, most preferably 0-0.10%.

(9) S (Sulfur): (Nb/20−0.1) to 0.2%

S is an important element for providing the heat-resistant, ferritic cast steel of the present invention with sufficient gas defect resistance. S is combined with Mn and Cr to form manganese chromium sulfide (MnCr)S, improving the gas defect resistance. (MnCr)S is crystallized as eutectic sulfide [δ+(MnCr)S] of (MnCr)S and the δ phase, after the eutectic (δ+NbC) phase is solidified. The eutectic sulfide [δ+(MnCr)S] is solidified after the eutectic (δ+NbC) phase, thereby lowering the solidification-terminating temperature and thus expanding the solidification temperature range. It is presumed that with the eutectic sulfide [δ+(MnCr)S] crystallized after the solidification of the eutectic (δ+NbC) phase, hydrogen discharged from the liquid phase during the crystallization of the eutectic (δ+NbC) phase escapes from the casting mold through a liquid phase in the solid-liquid phase of the eutectic sulfide [δ+(MnCr)S] before solidification, thereby suppressing gas defects.

The more the eutectic (δ+NbC) phase is crystallized, the more hydrogen is discharged. Accordingly, to have a large amount of solid-liquid phases providing paths for hydrogen to escape, the amount of the eutectic sulfide [δ+(MnCr)S] crystallized should be increased. In the composition range of the present invention, the amount of the eutectic (δ+NbC) phase crystallized depends on the Nb content, and the amount of the eutectic sulfide [δ+(MnCr)S] crystallized depends on the S content. To suppress gas defects, it is necessary to have a sufficient amount of the eutectic sulfide [δ+(MnCr)S] crystallized depending on the amount of the eutectic (δ+NbC) phase crystallized, and thus the necessary amount (lower limit) of S should be increased in proportion to the Nb content. Investigation of the relation between the amounts of Nb and S and the generation of gas defects has revealed that the amount of S necessary for suppressing gas defects is (Nb/20−0.1) % or more. However, when S is excessively more than 0.2%, the toughness decreases drastically. Accordingly, the S content is (Nb/20−0.1) to 0.2%. In the present invention, the lower limit of the S content is 0.06% when Nb is 3.2%, and 0.125% when Nb is 4.5%. Accordingly, the S content is in a range of 0.06-0.2%. The S content is preferably 0.125-0.2%, more preferably 0.13-0.2%, most preferably 0.13-0.17%.

(10) W (Tungsten) and/or Mo (Molybdenum): 3.2% or Less in Total (W+Mo)

W and Mo are dissolved in the 6 phase in the matrix structure to form a solid solution, improving the high-temperature strength. The effect of W and Mo added is saturated at about 3% when either one is added, and at about 3% in total when both of them are added. Further, when the amount of W or Mo added alone exceeds 3.2%, or when the total amount of W and Mo added together exceeds 3.2%, coarse carbide is formed, resulting in extremely deteriorated toughness and machinability. Accordingly, the amount of W and/or Mo in total (W+Mo) is 3.2% or less (including 0%). The total amount of W and/or Mo is preferably 0-3.0%, more preferably 0-2.5%. Particularly when the toughness is needed, the amount of W and/or Mo in total is preferably 0-1.0%, more preferably 0-0.5%, most preferably 0-0.3%. Particularly when the high-temperature strength is needed, the amount of W and/or Mo in total is preferably 0.8-3.2%, more preferably 1.0-3.2%, most preferably 1.0-2.5%.

(B) Structure (1) Area Ratio of Eutectic (δ+NbC) Phase: 60-80%

In the heat-resistant, ferritic cast steel of the present invention, the control of the amount of a eutectic (δ+NbC) phase crystallized from a δ phase and Nb carbide (NbC) is important to have enough toughness. In the heat-resistant, ferritic cast steel of the present invention, a relatively large amount of the eutectic (δ+NbC) phase is solidified in a short period of time after the solidification of the primary δ phase in the course of solidification in casting, so that the solidified eutectic (δ+NbC) phase hinders and suppresses the growth of the primary δ phase, resulting in fine crystal grains of the primary δ phase. On the other hand, the growth of the eutectic (δ+NbC) phase is also hindered and suppressed by the solidified primary δ phase, resulting in fine crystal grains of the eutectic (δ+NbC) phase. Accordingly, it is presumed that both of the primary δ phase and the eutectic (δ+NbC) phase hinder the growth of their crystal grains each other in the heat-resistant, ferritic cast steel of the present invention, resulting in finer crystal grains, and thus drastically improved toughness. To obtain this effect, the area ratio of the eutectic (δ+NbC) phase should be 60-80% of the total area (100%) of the structure. When the area ratio of the eutectic (δ+NbC) phase is less than 60%, the primary δ phase forms coarse crystal grains, failing to improve the toughness. On the other hand, when the area ratio of the eutectic (δ+NbC) phase exceeds 80%, an excessive amount of the eutectic (δ+NbC) phase is crystallized with coarse crystal grains, resulting in embrittlement and extremely low toughness. Accordingly, the area ratio of the eutectic (δ+NbC) phase is controlled to 60-80%. To control the area ratio of the eutectic (δ+NbC) phase to 60-80%, the amounts of C and Nb and the Nb/C ratio are limited to the above ranges. The area ratio of the eutectic (δ+NbC) phase is preferably 60-78%, more preferably 60-76%, most preferably 60-74%.

(2) Area Ratio of Manganese Chromium Sulfide (MnCr)S: 0.2-1.2%

In the heat-resistant, ferritic cast steel of the present invention, the control of the amount of manganese chromium sulfide (MnCr)S precipitated is important to have enough gas defect resistance. A solidification temperature range is expanded by lowering a solidification-terminating temperature by having a proper amount of the eutectic sulfide [δ+(MnCr)S] of (MnCr)S and the δ phase solidified after the eutectic (δ+NbC) phase. To obtain sufficient gas defect resistance by such phenomenon, the area ratio of manganese chromium sulfide (MnCr)S should be 0.2% or more of the total area (100%) of the structure. However, when the area ratio of (MnCr)S exceeds 1.2%, an excessive amount of the eutectic sulfide [δ+(MnCr)S] is crystallized, resulting in toughness-deteriorating embrittlement. Accordingly, the area ratio of manganese chromium sulfide (MnCr)S is controlled to 0.2-1.2%. To control the area ratio of (MnCr)S, the S content is limited to the above range. The area ratio of manganese chromium sulfide (MnCr)S is preferably 0.2-1.0%, more preferably 0.3-1.0%, most preferably 0.5-1.0%.

[2] Exhaust Members

The exhaust members of the present invention made from the above heat-resistant, ferritic cast steel include any cast exhaust members, with their preferred examples including exhaust manifolds, turbine housings, integrally cast turbine housings/exhaust manifolds, catalyst cases, integrally cast catalyst cases/exhaust manifolds, exhaust outlets, etc. Of course, the exhaust members of the present invention are not limited thereto, but include, for example, cast members welded to plate or pipe metal members.

The exhaust members of the present invention keep sufficient heat resistance properties such as sufficient oxidation resistance, thermal cracking resistance, thermal deformation resistance, etc., even when their surface temperatures reach about 900° C. by being exposed to an exhaust gas at as high temperatures as 1000° C. or higher. Thus, they exhibit high heat resistance and durability, suitable for exhaust manifolds, turbine housings, exhaust manifolds integral with turbine housings, catalyst cases, exhaust manifolds integral with catalyst cases and exhaust outlets. Also, Because of excellent melt flowability, gas defect resistance, toughness and machinability, and because of suppressed amounts of rare metals used and no necessity of heat treatment, they can be produced with high yield at low cost. It is thus expected that the present invention makes it possible to use inexpensive, fuel-efficiency-improving exhaust members with high heat resistance and durability in inexpensive popular cars, contributing to the reduction of $CO_2$ emission.

The present invention will be explained in more detail referring to Examples below without intention of restricting the present invention thereto. Unless otherwise mentioned, the amount of each element constituting the alloy is expressed by % by mass.

Examples 1-39 and Comparative Examples 1-34

The chemical composition of each cast steel sample is shown in Tables 1-1 and 1-2. Examples 1-39 are the heat-resistant, ferritic cast steels of the present invention, and Comparative Examples 1-30 are cast steels outside the scope of the present invention. Specifically, Comparative Example 1 is cast steel with too small C and Nb contents;

Comparative Examples 2-6, 16 and 17 are cast steels with too little S;

Comparative Examples 7-9 are cast steels with too large C and Nb contents;

Comparative Example 10 is cast steel with too little S and too much Cr;

Comparative Example 11 is cast steel with too little C;

Comparative Example 12 is cast steel with too much C;

Comparative Example 13 is cast steel with too much Si;

Comparative Example 14 is cast steel with too little Mn;

Comparative Example 15 is cast steel with too much Mn;

Comparative Example 18 and 19 are cast steels with too much S;

Comparative Example 20 is cast steel with too much Ni;

Comparative Example 21 is cast steel with too little Cr;

Comparative Example 22 is cast steel with too much Cr;

Comparative Example 23 is cast steel with too much W;

Comparative Example 24 is cast steel with too much Mo;

Comparative Example 25 and 26 are cast steels with too little Nb;

Comparative Example 27 is cast steel with too much Nb;

Comparative Example 28 is cast steel with too low Nb/C;

Comparative Example 29 is cast steel with too high Nb/C;

Comparative Example 30 is cast steel with too much N;

Comparative Example 31 is a general ferritic cast steel corresponding to CB-30;

Comparative Example 32 is one example of the heat-resistant, ferritic cast steels described in JP 7-197209 A;

Comparative Example 33 is one example of the ferritic, cast, stainless steels described in JP 2007-254885 A; and Comparative Example 34 is one example of the heat-resistant, ferritic cast steels described in JP 11-61343 A.

TABLE 1-1

| | Composition of Sample (% by mass)(1) | | | | | | | | | | | |
|---|---|---|---|---|---|---|---|---|---|---|---|---|
| No. | C | Si | Mn | S | Ni | Cr | W | Mo | Nb | N | Nb/C | S(2) |
| Example 1 | 0.33 | 0.42 | 0.51 | 0.081 | 0.72 | 18.0 | —(3) | —(3) | 3.3 | 0.081 | 10.0 | 0.065 |
| Example 2 | 0.32 | 0.43 | 0.50 | 0.132 | 0.64 | 18.1 | — | — | 3.2 | 0.080 | 10.0 | 0.060 |
| Example 3 | 0.33 | 0.42 | 0.50 | 0.194 | 0.70 | 18.0 | — | — | 3.3 | 0.085 | 10.0 | 0.065 |
| Example 4 | 0.35 | 0.52 | 0.49 | 0.089 | 0.81 | 17.9 | — | — | 3.5 | 0.082 | 10.0 | 0.075 |
| Example 5 | 0.35 | 0.50 | 0.48 | 0.147 | 0.74 | 17.9 | — | — | 3.5 | 0.080 | 10.0 | 0.075 |
| Example 6 | 0.35 | 0.51 | 0.50 | 0.193 | 0.73 | 18.0 | — | — | 3.5 | 0.084 | 10.0 | 0.075 |
| Example 7 | 0.38 | 0.49 | 0.50 | 0.108 | 0.62 | 18.2 | — | — | 3.9 | 0.086 | 10.3 | 0.095 |
| Example 8 | 0.38 | 0.51 | 0.52 | 0.154 | 0.65 | 18.1 | — | — | 3.9 | 0.083 | 10.3 | 0.095 |
| Example 9 | 0.38 | 0.50 | 0.50 | 0.183 | 0.68 | 18.1 | — | — | 3.9 | 0.088 | 10.3 | 0.095 |
| Example 10 | 0.41 | 0.49 | 0.49 | 0.115 | 0.75 | 17.9 | — | — | 4.2 | 0.078 | 10.2 | 0.110 |
| Example 11 | 0.42 | 0.51 | 0.52 | 0.149 | 0.71 | 18.1 | — | — | 4.1 | 0.076 | 9.8 | 0.105 |
| Example 12 | 0.42 | 0.52 | 0.51 | 0.190 | 0.73 | 18.0 | — | — | 4.2 | 0.08 | 10.0 | 0.110 |
| Example 13 | 0.44 | 0.45 | 0.47 | 0.128 | 0.66 | 19.8 | — | — | 4.5 | 0.093 | 10.2 | 0.125 |
| Example 14 | 0.45 | 0.50 | 0.55 | 0.188 | 0.64 | 19.9 | — | — | 4.4 | 0.095 | 9.8 | 0.120 |
| Example 15 | 0.38 | 0.51 | 0.49 | 0.147 | 0.76 | 21.0 | — | — | 3.8 | 0.087 | 10.0 | 0.090 |
| Example 16 | 0.38 | 0.50 | 0.50 | 0.156 | 0.73 | 22.5 | — | — | 3.8 | 0.085 | 10.0 | 0.090 |
| Example 17 | 0.38 | 0.50 | 0.52 | 0.138 | 0.63 | 19.8 | 1.0 | — | 3.8 | 0.086 | 10.0 | 0.090 |
| Example 18 | 0.38 | 0.52 | 0.51 | 0.162 | 0.67 | 19.8 | 2.0 | — | 3.8 | 0.084 | 10.0 | 0.090 |
| Example 19 | 0.38 | 0.51 | 0.50 | 0.151 | 0.65 | 19.8 | 2.5 | — | 3.8 | 0.081 | 10.0 | 0.090 |
| Example 20 | 0.38 | 0.50 | 0.49 | 0.143 | 0.62 | 19.8 | 1.0 | 1.0 | 3.8 | 0.083 | 10.0 | 0.090 |
| Example 21 | 0.38 | 0.50 | 0.50 | 0.159 | 0.68 | 19.8 | 1.0 | 1.5 | 3.8 | 0.086 | 10.0 | 0.090 |
| Example 22 | 0.38 | 0.49 | 0.50 | 0.132 | 0.78 | 21.0 | 2.3 | — | 3.8 | 0.085 | 10.0 | 0.090 |
| Example 23 | 0.38 | 0.51 | 0.50 | 0.154 | 0.71 | 22.5 | 2.3 | — | 3.8 | 0.080 | 10.0 | 0.090 |
| Example 24 | 0.38 | 0.54 | 0.52 | 0.130 | 0.74 | 18.6 | 1.0 | — | 3.6 | 0.079 | 9.5 | 0.080 |
| Example 25 | 0.38 | 0.53 | 0.50 | 0.169 | 0.65 | 18.4 | 1.0 | — | 3.9 | 0.083 | 10.3 | 0.095 |
| Example 26 | 0.32 | 0.58 | 0.52 | 0.151 | 0.72 | 19.7 | 2.2 | — | 3.2 | 0.075 | 10.0 | 0.060 |
| Example 27 | 0.34 | 0.56 | 0.51 | 0.150 | 0.71 | 19.7 | 2.1 | — | 3.4 | 0.078 | 10.0 | 0.070 |
| Example 28 | 0.36 | 0.55 | 0.50 | 0.153 | 0.73 | 19.8 | 2.2 | — | 3.6 | 0.072 | 10.0 | 0.080 |
| Example 29 | 0.39 | 0.57 | 0.53 | 0.149 | 0.70 | 19.8 | 2.3 | — | 4.2 | 0.080 | 10.8 | 0.110 |
| Example 30 | 0.38 | 0.35 | 1.25 | 0.156 | 0.62 | 16.0 | 1.0 | — | 4.0 | 0.125 | 10.5 | 0.100 |
| Example 31 | 0.37 | 0.85 | 1.83 | 0.091 | 1.25 | 16.1 | 0.9 | — | 3.7 | 0.148 | 10.0 | 0.085 |

TABLE 1-1-continued

| No. | Composition of Sample (% by mass)[1] | | | | | | | | | | | |
|---|---|---|---|---|---|---|---|---|---|---|---|---|
| | C | Si | Mn | S | Ni | Cr | W | Mo | Nb | N | Nb/C | S[2] |
| Example 32 | 0.32 | 0.84 | 0.15 | 0.061 | 0.66 | 19.6 | 1.4 | — | 3.2 | 0.071 | 10.0 | 0.060 |
| Example 33 | 0.37 | 0.59 | 0.48 | 0.101 | 0.05 | 19.8 | 1.2 | — | 3.8 | 0.010 | 10.3 | 0.090 |
| Example 34 | 0.35 | 0.38 | 0.42 | 0.072 | 0.65 | 16.2 | 3.2 | — | 3.3 | 0.075 | 9.4 | 0.065 |
| Example 35 | 0.33 | 0.37 | 0.44 | 0.069 | 0.68 | 16.1 | — | 3.2 | 3.2 | 0.077 | 9.7 | 0.060 |
| Example 36 | 0.43 | 0.50 | 0.47 | 0.131 | 0.69 | 19.8 | 1.5 | — | 3.9 | 0.073 | 9.1 | 0.095 |
| Example 37 | 0.35 | 0.58 | 0.51 | 0.198 | 0.76 | 18.3 | 0.9 | — | 3.2 | 0.085 | 9.1 | 0.060 |
| Example 38 | 0.39 | 0.52 | 0.49 | 0.126 | 0.66 | 16.3 | 1.5 | — | 4.5 | 0.071 | 11.5 | 0.125 |
| Example 39 | 0.45 | 0.49 | 0.50 | 0.195 | 0.67 | 16.2 | 1.5 | — | 4.5 | 0.069 | 10.0 | 0.125 |

Note:
[1]The balance are Fe and inevitable impurities.
[2]The necessary amount of S calculated by the formula of (Nb/20 − 0.1).
[3]The symbol "—" in the columns of W and Mo means less than 0.1% by mass.

TABLE 1-2

| No. | Composition of Sample (% by mass)[1] | | | | | | | | | | | |
|---|---|---|---|---|---|---|---|---|---|---|---|---|
| | C | Si | Mn | S | Ni | Cr | W | Mo | Nb | N | Nb/C | S[2] |
| Com. Ex. 1 | 0.31 | 0.41 | 0.42 | 0.147 | 0.60 | 18.1 | —[3] | —[3] | 3.1 | 0.081 | 10.0 | 0.055 |
| Com. Ex. 2 | 0.32 | 0.52 | 0.53 | 0.041 | 0.77 | 18.0 | — | — | 3.2 | 0.080 | 10.0 | 0.060 |
| Com. Ex. 3 | 0.35 | 0.55 | 0.45 | 0.054 | 0.73 | 17.9 | — | — | 3.5 | 0.089 | 10.0 | 0.075 |
| Com. Ex. 4 | 0.38 | 0.51 | 0.41 | 0.072 | 0.74 | 17.8 | — | — | 3.9 | 0.088 | 10.3 | 0.095 |
| Com. Ex. 5 | 0.42 | 0.43 | 0.62 | 0.088 | 0.62 | 18.1 | — | — | 4.2 | 0.085 | 10.0 | 0.110 |
| Com. Ex. 6 | 0.44 | 0.42 | 0.55 | 0.101 | 0.71 | 18.0 | — | — | 4.4 | 0.083 | 10.0 | 0.120 |
| Com. Ex. 7 | 0.46 | 0.49 | 0.59 | 0.123 | 0.63 | 17.9 | — | — | 4.6 | 0.084 | 10.0 | 0.130 |
| Com. Ex. 8 | 0.46 | 0.60 | 0.48 | 0.152 | 0.67 | 18.2 | — | — | 4.6 | 0.086 | 10.0 | 0.130 |
| Com. Ex. 9 | 0.46 | 0.52 | 0.50 | 0.194 | 0.66 | 17.8 | — | — | 4.6 | 0.081 | 10.0 | 0.130 |
| Com. Ex. 10 | 0.33 | 0.60 | 0.58 | 0.012 | 0.75 | 26.0 | — | — | 3.2 | 0.012 | 9.7 | 0.060 |
| Com. Ex. 11 | 0.30 | 0.54 | 0.61 | 0.095 | 0.72 | 18.1 | 1.0 | — | 3.4 | 0.087 | 11.3 | 0.070 |
| Com. Ex. 12 | 0.49 | 0.52 | 0.57 | 0.142 | 0.69 | 18.0 | 1.0 | — | 4.5 | 0.081 | 9.2 | 0.125 |
| Com. Ex. 13 | 0.38 | 0.92 | 0.48 | 0.140 | 0.71 | 17.5 | 1.1 | — | 3.7 | 0.081 | 9.7 | 0.085 |
| Com. Ex. 14 | 0.33 | 0.52 | 0.13 | 0.127 | 0.69 | 18.1 | 1.2 | — | 3.3 | 0.078 | 10.0 | 0.065 |
| Com. Ex. 15 | 0.34 | 0.58 | 2.17 | 0.131 | 0.67 | 17.9 | 1.0 | — | 3.4 | 0.076 | 10.0 | 0.070 |
| Com. Ex. 16 | 0.32 | 0.51 | 0.53 | 0.053 | 0.70 | 18.0 | 0.9 | — | 3.2 | 0.077 | 10.0 | 0.060 |
| Com. Ex. 17 | 0.40 | 0.50 | 0.52 | 0.088 | 0.72 | 17.8 | 1.0 | — | 3.9 | 0.075 | 9.8 | 0.095 |
| Com. Ex. 18 | 0.37 | 0.49 | 0.51 | 0.212 | 0.73 | 17.7 | 1.0 | — | 3.7 | 0.076 | 10.0 | 0.085 |
| Com. Ex. 19 | 0.38 | 0.48 | 0.54 | 0.231 | 0.71 | 17.9 | 0.9 | — | 3.8 | 0.074 | 10.0 | 0.090 |
| Com. Ex. 20 | 0.35 | 0.48 | 0.50 | 0.135 | 1.61 | 17.8 | 1.0 | — | 3.6 | 0.074 | 10.3 | 0.080 |
| Com. Ex. 21 | 0.38 | 0.55 | 0.51 | 0.146 | 0.69 | 15.4 | 0.9 | — | 3.8 | 0.077 | 10.0 | 0.090 |
| Com. Ex. 22 | 0.38 | 0.54 | 0.50 | 0.143 | 0.68 | 24.0 | 1.0 | — | 3.8 | 0.078 | 10.0 | 0.090 |
| Com. Ex. 23 | 0.35 | 0.52 | 0.49 | 0.132 | 0.72 | 18.3 | 3.5 | — | 3.5 | 0.081 | 10.0 | 0.075 |
| Com. Ex. 24 | 0.36 | 0.50 | 0.47 | 0.133 | 0.74 | 18.2 | — | 3.4 | 3.5 | 0.082 | 9.7 | 0.075 |
| Com. Ex. 25 | 0.38 | 0.65 | 0.68 | 0.116 | 0.70 | 17.6 | 1.1 | — | 2.8 | 0.083 | 7.4 | 0.040 |
| Com. Ex. 26 | 0.33 | 0.64 | 0.67 | 0.112 | 0.69 | 17.5 | 1.0 | — | 3.0 | 0.080 | 9.1 | 0.050 |
| Com. Ex. 27 | 0.42 | 0.53 | 0.60 | 0.198 | 0.67 | 17.8 | 0.9 | — | 4.7 | 0.079 | 11.2 | 0.135 |
| Com. Ex. 28 | 0.40 | 0.55 | 0.61 | 0.153 | 0.64 | 18.1 | 0.9 | — | 3.4 | 0.078 | 8.5 | 0.070 |
| Com. Ex. 29 | 0.35 | 0.53 | 0.62 | 0.157 | 0.66 | 18.2 | 1.0 | — | 4.2 | 0.076 | 12.0 | 0.110 |
| Com. Ex. 30 | 0.35 | 0.49 | 0.49 | 0.131 | 0.73 | 17.6 | 0.9 | — | 3.5 | 0.168 | 10.0 | 0.075 |
| Com. Ex. 31 | 0.15 | 0.81 | 0.82 | 0.022 | 0.79 | 18.4 | — | — | 0.1 | 0.084 | 0.7 | −0.095 |
| Com. Ex. 32 | 0.45 | 0.95 | 0.54 | 0.009 | 0.95 | 19.9 | 2.9 | — | 2.0 | 0.060 | 4.4 | 0.000 |
| Com. Ex. 33 | 0.25 | 2.80 | 0.52 | 0.010 | 0.12 | 20.1 | — | 0.1 | 3.8 | 0.005 | 15.2 | 0.090 |
| Com. Ex. 34 | 0.41 | 0.51 | 0.49 | 0.010 | 0.83 | 18.5 | 1.9 | — | 4.2 | 0.055 | 10.2 | 0.110 |

Note:
[1]The balance are Fe and inevitable impurities.
[2]The necessary amount of S calculated by the formula of (Nb/20 − 0.1).
[3]The symbol "—" in the columns of W and Mo means less than 0.1% by mass.

Each cast steel of Examples 1-39 and Comparative Examples 1-34 was melted in a 100-kg, high-frequency furnace with a basic lining in the air, taken out of the furnace at 1600-1650° C., and immediately poured at about 1550° C. into a shell-cup mold with an R-type thermocouple for measuring the solidification start temperature, a mold for casting a spiral test piece for measuring the melt flowability, a mold for casting a flat test piece for evaluating the gas defect resistance, a mold for casting a one-inch Y-block, a mold for casting a stepped Y-block, and a mold for casting a cylindrical block for evaluating the machinability, to produce a sample. Each as-cast steel without heat treatment was evaluated with respect to a solidification start temperature, a melt flowability length, a microstructure, the number of gas defects, a room-temperature impact strength, a tool life, weight loss by oxidation, a high-temperature strength, and a thermal fatigue life. The evaluation methods and results are shown below.

(1) Solidification Start Temperature

The melt was poured into a shell-cup mold with an R-type thermocouple to measure the solidification start temperature. The results are shown in Tables 2-1 and 2-2. The solidification start temperature is desirably lower than 1440° C. as described above, and all of Examples 1-39 met this requirement. On the other hand, the solidification start temperatures of Comparative Examples 1, 11, 25 and 31-33 were 1440° C. or higher. This is because they had the C or Nb content outside the range of the present invention. The solidification start temperature of Comparative Example 33 having a large Nb content was 1430° C., lower than 1440° C., but Comparative Example 33 had many gas defects as described later, poor in gas defect resistance.

(2) Melt Flowability Length

The length of a casting formed in a runner for a melt-flowability-measuring spiral test piece, the distance (mm) of a melt from a sprue to its tip end, was measured as a melt flowability length. The measurement results of the melt flowability length are shown in Tables 2-1 and 2-2. Because a larger melt flowability length means better melt flowability, the melt flowability was evaluated by the melt flowability length. As is clear from Tables 2-1 and 2-2, any of Examples 1-39 had as large melt flowability length as 1100 mm or more. On the other hand, in Comparative Examples 1, 11, 25, 31 and 32 having a smaller content of C and/or Nb than the range of the present invention, the melt flowability length was as small as 1100 mm or less. The comparison of Example 14 and Comparative Example 32 having the same C content and different Nb contents revealed that Example 14 having the Nb content of 4.4% had a melt flowability length of 1275 mm, while Comparative Example 32 having the Nb content of 2.0% had a melt flowability length of 1012 mm, only about 80% of Example 14, poor in melt flowability. Comparative Example 33 had a melt flowability length of 1247 mm, good melt flowability, despite as small a C content as 0.25%. The reason therefor seems to be that it contained 2.80% of Si having a function of improving the melt flowability. However, Comparative Example 33 had low room-temperature impact strength, insufficient toughness, despite improved melt flowability. These results indicate that the heat-resistant, ferritic cast steels of the present invention containing large amounts of C and Nb have good melt flowability.

(3) Microstructure

A structure-observing test piece was cut out of each one-inch Y-block sample, to measure the area ratios of manganese chromium sulfide (MnCr)S and a eutectic (δ+NbC) phase. The area ratio of manganese chromium sulfide (MnCr)S was determined by observing five arbitrary fields of an un-etched test piece taken by an optical microscope (magnification: 100 times), measuring the area ratio in each field by an image analyzer, and averaging them. The area ratio of the eutectic (δ+NbC) phase was determined by taking optical photomicrographs (magnification: 100 times) of a mirror-polished, etched surface of a test piece in five arbitrary fields, painting portions of the eutectic (δ+NbC) phase in each field with a black color, measuring the area ratio of black portions by an image analyzer, and averaging them. The measurement results of the area ratio of manganese chromium sulfide (MnCr)S are shown in Tables 2-1 and 2-2, and the measurement results of the area ratio of the eutectic (δ+NbC) phase are shown in Tables 3-1 and 3-2.

(4) Number of Gas Defects

An X-ray radiograph of each flat cast test piece for evaluating gas defects was taken to measure the number of gas defects by the naked eye. The measurement results of the number of gas defects are shown in Table 2-1 and Table 2-2. Because a smaller number of gas defects means higher gas defect resistance, the gas defect resistance was evaluated by the number of gas defects. Any of Examples 1-39 was free from gas defects, exhibiting excellent gas defect resistance. On the other hand, any of Comparative Examples 2-6, 10, 16, 17, 33 and 34 having a smaller S content than necessitated by the Nb content had a large number of gas defects. Because any of Comparative Examples 7-9 and 27 had a Nb content exceeding the upper limit of 4.5% in the present invention, it had a large number of gas defects. Because Comparative Example 13 had a Si content exceeding the upper limit of 0.85% in the present invention, it had a large number of gas defects. Because Comparative Example 14 had a Mn content less than the lower limit of 0.15% in the present invention, it had a large number of gas defects. Accordingly, these Comparative Examples were poor in gas defect resistance.

TABLE 2-1

| | Evaluation Results of Sample | | | |
|---|---|---|---|---|
| No. | Solidification Start Temperature (° C.) | Melt Flowability Length (mm) | Area Ratio of (MnCr)S (%) | Number of Gas Defects |
| Example 1 | 1432 | 1141 | 0.35 | 0 |
| Example 2 | 1432 | 1134 | 0.55 | 0 |
| Example 3 | 1435 | 1159 | 0.88 | 0 |
| Example 4 | 1430 | 1195 | 0.41 | 0 |
| Example 5 | 1428 | 1190 | 0.65 | 0 |
| Example 6 | 1428 | 1187 | 0.85 | 0 |
| Example 7 | 1422 | 1220 | 0.50 | 0 |
| Example 8 | 1420 | 1226 | 0.65 | 0 |
| Example 9 | 1421 | 1223 | 0.80 | 0 |
| Example 10 | 1415 | 1249 | 0.56 | 0 |
| Example 11 | 1416 | 1251 | 0.67 | 0 |
| Example 12 | 1418 | 1257 | 0.84 | 0 |
| Example 13 | 1411 | 1238 | 0.60 | 0 |
| Example 14 | 1410 | 1275 | 0.85 | 0 |
| Example 15 | 1421 | 1223 | 0.66 | 0 |
| Example 16 | 1420 | 1218 | 0.65 | 0 |
| Example 17 | 1423 | 1223 | 0.66 | 0 |
| Example 18 | 1422 | 1235 | 0.64 | 0 |
| Example 19 | 1422 | 1238 | 0.66 | 0 |
| Example 20 | 1419 | 1220 | 0.68 | 0 |
| Example 21 | 1419 | 1218 | 0.63 | 0 |
| Example 22 | 1420 | 1226 | 0.65 | 0 |
| Example 23 | 1419 | 1237 | 0.66 | 0 |
| Example 24 | 1424 | 1223 | 0.55 | 0 |
| Example 25 | 1423 | 1224 | 0.79 | 0 |
| Example 26 | 1433 | 1160 | 0.67 | 0 |
| Example 27 | 1430 | 1183 | 0.67 | 0 |
| Example 28 | 1426 | 1206 | 0.68 | 0 |
| Example 29 | 1420 | 1254 | 0.69 | 0 |
| Example 30 | 1423 | 1231 | 0.72 | 0 |
| Example 31 | 1418 | 1244 | 0.46 | 0 |
| Example 32 | 1431 | 1157 | 0.24 | 0 |
| Example 33 | 1423 | 1231 | 0.45 | 0 |
| Example 34 | 1432 | 1163 | 0.26 | 0 |
| Example 35 | 1435 | 1159 | 0.25 | 0 |
| Example 36 | 1412 | 1256 | 0.58 | 0 |
| Example 37 | 1430 | 1185 | 1.15 | 0 |
| Example 38 | 1408 | 1268 | 0.57 | 0 |
| Example 39 | 1409 | 1281 | 0.88 | 0 |

TABLE 2-2

| | Evaluation Results of Sample | | | |
|---|---|---|---|---|
| No. | Solidification Start Temperature (° C.) | Melt Flowability Length (mm) | Area Ratio of (MnCr)S (%) | Number of Gas Defects |
| Com. Ex. 1 | 1445 | 1082 | 0.65 | 0 |
| Com. Ex. 2 | 1430 | 1148 | 0.18 | 10 |
| Com. Ex. 3 | 1425 | 1195 | 0.22 | 10 |
| Com. Ex. 4 | 1420 | 1217 | 0.30 | 12 |
| Com. Ex. 5 | 1414 | 1235 | 0.39 | 13 |
| Com. Ex. 6 | 1410 | 1249 | 0.43 | 15 |
| Com. Ex. 7 | 1405 | 1287 | 0.55 | 20 |
| Com. Ex. 8 | 1406 | 1298 | 0.66 | 22 |
| Com. Ex. 9 | 1405 | 1294 | 0.85 | 26 |
| Com. Ex. 10 | 1427 | 1154 | 0.06 | 14 |
| Com. Ex. 11 | 1443 | 1067 | 0.40 | 0 |

TABLE 2-2-continued

| No. | Evaluation Results of Sample | | | |
|---|---|---|---|---|
| | Solidification Start Temperature (° C.) | Melt Flowability Length (mm) | Area Ratio of (MnCr)S (%) | Number of Gas Defects |
| Com. Ex. 12 | 1406 | 1298 | 0.59 | 0 |
| Com. Ex. 13 | 1420 | 1292 | 0.56 | 8 |
| Com. Ex. 14 | 1432 | 1137 | 0.16 | 5 |
| Com. Ex. 15 | 1430 | 1154 | 0.71 | 0 |
| Com. Ex. 16 | 1434 | 1173 | 0.19 | 9 |
| Com. Ex. 17 | 1420 | 1235 | 0.37 | 5 |
| Com. Ex. 18 | 1425 | 1211 | 1.07 | 0 |
| Com. Ex. 19 | 1423 | 1218 | 1.25 | 0 |
| Com. Ex. 20 | 1428 | 1201 | 0.55 | 0 |
| Com. Ex. 21 | 1422 | 1196 | 0.46 | 0 |
| Com. Ex. 22 | 1422 | 1235 | 0.78 | 0 |
| Com. Ex. 23 | 1428 | 1204 | 0.55 | 0 |
| Com. Ex. 24 | 1428 | 1208 | 0.55 | 0 |
| Com. Ex. 25 | 1445 | 1092 | 0.53 | 0 |
| Com. Ex. 26 | 1435 | 1138 | 0.48 | 0 |
| Com. Ex. 27 | 1411 | 1287 | 0.82 | 21 |
| Com. Ex. 28 | 1424 | 1219 | 0.44 | 0 |
| Com. Ex. 29 | 1422 | 1240 | 0.85 | 0 |
| Com. Ex. 30 | 1429 | 1212 | 0.53 | 0 |
| Com. Ex. 31 | 1485 | 780 | 0.08 | 3 |
| Com. Ex. 32 | 1445 | 1012 | 0.03 | 0 |
| Com. Ex. 33 | 1440 | 1247 | 0.05 | 5 |
| Com. Ex. 34 | 1430 | 1232 | 0.04 | 13 |

(5) Room-Temperature Impact Strength

With respect to members which are likely cracked and broken by an external force such as mechanical vibration and shock, a Charpy impact test providing a higher propagation speed of cracking is more relevant than a tensile test as a toughness-evaluating method, because cracking has a high propagation speed in such members. Thus, to evaluate the toughness at room temperature, the room-temperature impact strength was measured by a Charpy impact test.

An un-notched Charpy impact test piece having the shape and size defined in JIS Z 2242 was cut out of each stepped Y-block sample. Using a test machine having a capacity of 50 J, the impact test was conducted on three test pieces at 23° C. according to JIS Z 2242, and the measured impact strength was averaged. The impact test results are shown in Tables 3-1 and 3-2.

To have enough toughness to avoid cracking and breakage in the production process of exhaust members, etc., the room-temperature impact strength is preferably $7\times10^4$ J/m$^2$ or more, more preferably $10\times10^4$ J/m$^2$ or more. All of Examples 1-32 exhibited room-temperature impact strength of $7\times10^4$ J/m$^2$ or more. Because the heat-resistant, ferritic cast steel of the present invention contains desired amounts of C and Nb, with an optimum ratio of the primary δ phase to the eutectic (δ+NbC) phase to make crystal grains fine, it is considered to have high room-temperature impact strength, namely excellent toughness.

On the other hand, because Comparative Example 10 contained excessive Cr, Comparative Example 11 contained too little C and had too small an area ratio of a eutectic (δ+NbC) phase, Comparative Example 13 and 33 contained excessive Si, Comparative Example 19 contained excessive S, Comparative Example 20 contained excessive Ni, Comparative Examples 23 and 24 contained excessive W or Mo, Comparative Examples 25 and 26 contained too little Nb and had too small an area ratio of a eutectic (δ+NbC) phase, Comparative Example 28 had too low Nb/C and too small an area ratio of a eutectic (δ+NbC) phase, and Comparative Example 30 contained excessive N, they exhibited low room-temperature impact strength, poor toughness.

(6) Tool Life

An end surface of a test piece cut out of each cylindrical sample was machined under the conditions described below by a milling machine using a chip of a cemented carbide substrate coated with TiN by PVD as a tool, to measure the cutting distance (cm) until the maximum wear depth of a chip flank reached 0.1 mm, as a tool life. The measurement results of tool lives are shown in Tables 3-1 and 3-2. Because a longer cutting distance means better machinability of the test piece, the machinability of the test piece can be evaluated by the cutting distance.

Cutting speed: 90 m/minute;
Rotation speed: 229 rpm;
Feed per one blade: 0.2 mm/tooth;
Feeding speed: 48 mm/minute;
Cutting depth: 1.0 mm; and
Cutting oil: Not used (dry).

As is clear from Tables 3-1 and 3-2, any of Examples 1-39 had as long a tool life as 1500 cm or more, good machinability. On the other hand, because Comparative Examples 10 and 22 contained excessive Cr, Comparative Example 15 contained excessive Mn, Comparative Example 20 contained excessive Ni, Comparative Examples 23 and 24 contained excessive W or Mo, Comparative Examples 25, 26, 31 and 32 contained too little Nb, Comparative Example 28 had too low Nb/C, and Comparative Example 30 contained excessive N, they had as short tool lives as less than 1500 cm, poor machinability.

(7) Weight Loss by Oxidation

Because exhaust members are exposed to high-temperature, oxidizing exhaust gases discharged from engines, which contain sulfur oxides, nitrogen oxides, etc., high oxidation resistance is required for them. Because the temperature of an exhaust gas discharged from engine combustion chambers is as high as nearly 1000° C., exhaust members are heated to nearly 900° C. Accordingly, the temperature for evaluating oxidation resistance was set at 900° C. The oxidation resistance was determined by keeping a round rod test piece of 10 mm in diameter and 20 mm in length cut out of each one-inch Y-block sample at 900° C. for 200 hours in the air, shot-blasting it to remove oxide scales, and then measuring weight change per a unit area before and after the oxidation test, namely weight loss (mg/cm$^2$) by oxidation. The measurement results of the weight loss by oxidation are shown in Tables 3-1 and 3-2.

To make the heat-resistant, ferritic cast steel usable for exhaust members whose temperatures reach about 900° C., it preferably has weight loss by oxidation (measured after being kept at 900° C. for 200 hours in the air) of 20 mg/cm$^2$ or less. When the weight loss by oxidation exceeds 20 mg/cm$^2$, an oxide film acting as starting points of cracking is formed excessively, resulting in insufficient oxidation resistance. As is clear from Tables 3-1 and 3-2, all of Examples 1-39 had weight loss by oxidation of 20 mg/cm$^2$ or less. This indicates that the heat-resistant, ferritic cast steels of the present invention have sufficient oxidation resistance for use in exhaust members whose temperatures reach about 900° C. Why the heat-resistant, ferritic cast steels of the present invention have sufficient oxidation resistance is that they contain 16% or more of Cr. On the other hand, because Comparative Example 15 contained excessive Mn, and Comparative Example 21 contained too little Cr, they had weight loss by oxidation of more than 20 mg/cm$^2$, poor oxidation resistance.

(8) High-Temperature Yield Strength

A smooth, flanged, round rod test piece (diameter: 10 mm, and gauge distance: 50 mm) cut out of each one-inch Y-block sample was attached to an electric-hydraulic servo test machine to measure 0.2% yield strength (MPa) at 900° C. in the air. The 0.2% yield strength at 900° C. is an index of the high-temperature strength and thermal deformation resistance of exhaust members. The measurement results of 0.2% yield strength at 900° C. are shown in Tables 3-1 and 3-2.

In general, metal materials tend to have lower strength at higher temperatures, more easily subject to thermal deformation. Particularly heat-resistant, ferritic cast steel having a body-centered cubic (bcc) structure is lower in high-temperature strength than heat-resistant, austenitic cast steel having a face-centered cubic (fcc) structure. A main factor other than the shape and thickness affecting the thermal deformation is high-temperature yield strength. To be used for exhaust members whose temperatures reach about 900° C., the high-temperature yield strength at 900° C. is preferably 20 MPa or more, more preferably 25 MPa or more.

As is clear from Tables 3-1 and 3-2, Examples 1-39 had as high high-temperature yield strength as 20 MPa or more at 900° C. Among them, Examples 17-39 containing 0.9% or more of W and/or Mo had high-temperature yield strength of 25 MPa or more at 900° C., excellent high-temperature strength and thermal deformation resistance. On the other hand, Comparative Examples 1 and 31 containing small amounts of C and Nb had high-temperature yield strength of less than 20 MPa. This indicates that containing large amounts of C and Nb improves the toughness and the high-temperature strength. Incidentally, Comparative Example 32 had high high-temperature yield strength despite a small Nb content, presumably because it contains a large amount of W. Comparative Example 33 had high high-temperature yield strength despite a small C content, presumably because it contains a large amount of Si. The heat-resistant, ferritic cast steel of the present invention containing large amounts of C and Nb has substantially the same high-temperature strength as that of Comparative Examples 32 and 33 containing W or Si for improving high-temperature strength.

(9) Thermal Fatigue Life

Exhaust members are required to be resistant to thermal cracking by the repetition of start (heating) and stop (cooling) of engines, having long thermal fatigue lives. More cycles until cracking and deformation generated by the repeated cycles of heating and cooling in a thermal fatigue test cause thermal fatigue failure indicate a longer thermal fatigue life, meaning better heat resistance and durability.

The thermal fatigue life as an index of thermal cracking resistance was measured by attaching a smooth, round rod test piece of 10 mm in diameter and 20 mm in gauge length cut out of each one-inch Y-block sample to the same electric-hydraulic servo test machine as used in the high-temperature strength test at a constraint ratio of 0.5, and repeating heating/cooling cycles in the air, each cycle consisting of temperature elevation for 2 minutes, keeping the temperature for 1 minute, and cooling for 4 minutes, 7 minutes in total, with the lowest cooling temperature of 150° C., the highest heating temperature of 900° C., and a temperature amplitude of 750° C. A load-temperature diagram was determined from the change of a load caused by the repletion of heating and cooling, and the maximum tensile load at the second cycle was used as a reference (100%), to count the number of cycles when the maximum tensile load measured in each cycle decreased to 75%. Because thermal fatigue failure takes place with elongation and shrinkage by heating and cooling mechanically constrained, the above number of cycles can be used to determine the thermal fatigue life. The measurement results of the thermal fatigue life are shown in Tables 3-1 and 3-2.

The degree of mechanical constraint (constraint ratio) is expressed by (elongation by free thermal expansion−elongation under mechanical constraint)/(elongation by free thermal expansion). For instance, the constraint ratio of 1.0 is a mechanical constraint condition in which no elongation is permitted to a test piece heated, for instance, from 150° C. to 900° C. The constraint ratio of 0.5 is a mechanical constraint condition in which, for instance, only 1-mm elongation is permitted when the elongation by free thermal expansion is 2 mm. Accordingly, at a constraint ratio of 0.5, a compression load is applied during temperature elevation, while a tensile load is applied during temperature decrease. The constraint ratio was set at 0.5 in the thermal fatigue life test, because the constraint ratios of exhaust members for actual automobile engines are about 0.1-0.5 permitting elongation to some extent.

To use the heat-resistant, ferritic cast steel for exhaust members whose temperatures reach about 900° C., the thermal fatigue life under the above condition is desirably 1000 cycles or more. The thermal fatigue life of 1000 cycles or more means that the heat-resistant, ferritic cast steel has excellent thermal cracking resistance. As is clear from Tables 3-1 and 3-2, any of Examples 1-39 had a sufficiently long thermal fatigue life of 1400 cycles or more. This indicates that the heat-resistant, ferritic cast steel of the present invention exhibits sufficient thermal cracking resistance when used for exhaust members whose temperatures reach about 900° C.

As described above, the heat-resistant, ferritic cast steel of the present invention has high heat resistance properties (oxidation resistance, high-temperature strength, thermal deformation resistance and thermal cracking resistance) required for exhaust members whose temperatures reach about 900° C., as well as excellent melt flowability, gas defect resistance, toughness and machinability.

TABLE 3-1

| | Evaluation Results of Sample | | | | | |
|---|---|---|---|---|---|---|
| No. | Area Ratio of Eutectic (δ + NbC) (%) | RT Impact Strength(1) ($\times 10^4$ J/m$^2$) | Tool Life (cm) | Weight Loss by Oxidation(2) (mg/cm$^2$) | 0.2% Yield Strength(2) (MPa) | Thermal Fatigue Life (cycles) |
| Example 1 | 60 | 20.0 | 2315 | 2 | 20 | 1490 |
| Example 2 | 63 | 17.5 | 2416 | 3 | 20 | 1528 |
| Example 3 | 61 | 15.2 | 2542 | 2 | 21 | 1495 |
| Example 4 | 65 | 22.0 | 2335 | 3 | 22 | 1447 |
| Example 5 | 65 | 17.0 | 2459 | 3 | 22 | 1429 |
| Example 6 | 64 | 15.9 | 2547 | 4 | 21 | 1464 |
| Example 7 | 70 | 25.1 | 2403 | 2 | 22 | 1541 |
| Example 8 | 71 | 22.3 | 2496 | 3 | 22 | 1520 |
| Example 9 | 70 | 20.2 | 2550 | 2 | 23 | 1513 |
| Example 10 | 76 | 21.2 | 2431 | 3 | 24 | 1522 |
| Example 11 | 75 | 18.6 | 2487 | 4 | 22 | 1516 |

TABLE 3-1-continued

| No. | Evaluation Results of Sample | | | | | |
|---|---|---|---|---|---|---|
| | Area Ratio of Eutectic (δ + NbC) (%) | RT Impact Strength[1] ($\times 10^4$ J/m$^2$) | Tool Life (cm) | Weight Loss by Oxidation[2] (mg/cm$^2$) | 0.2% Yield Strength[2] (MPa) | Thermal Fatigue Life (cycles) |
| Example 12 | 76 | 15.2 | 2577 | 5 | 23 | 1510 |
| Example 13 | 80 | 16.9 | 2407 | 3 | 24 | 1532 |
| Example 14 | 79 | 15.7 | 2515 | 4 | 23 | 1538 |
| Example 15 | 70 | 15.3 | 2352 | 1 | 21 | 1547 |
| Example 16 | 69 | 13.9 | 2306 | 1 | 21 | 1556 |
| Example 17 | 69 | 12.1 | 2299 | 1 | 25 | 1513 |
| Example 18 | 70 | 12.5 | 2015 | 1 | 28 | 1500 |
| Example 19 | 71 | 10.5 | 1802 | 1 | 31 | 1520 |
| Example 20 | 68 | 12.1 | 2089 | 1 | 29 | 1495 |
| Example 21 | 68 | 10.6 | 1895 | 1 | 32 | 1505 |
| Example 22 | 69 | 10.3 | 1968 | 1 | 30 | 1510 |
| Example 23 | 69 | 10.8 | 1915 | 1 | 31 | 1507 |
| Example 24 | 64 | 13.3 | 2282 | 2 | 25 | 1503 |
| Example 25 | 70 | 13.7 | 2410 | 3 | 27 | 1507 |
| Example 26 | 61 | 11.2 | 2018 | 1 | 29 | 1521 |
| Example 27 | 64 | 11.9 | 2066 | 1 | 30 | 1512 |
| Example 28 | 67 | 12.5 | 2068 | 1 | 31 | 1515 |
| Example 29 | 77 | 11.9 | 2048 | 1 | 32 | 1528 |
| Example 30 | 74 | 13.2 | 2376 | 4 | 26 | 1517 |
| Example 31 | 65 | 12.8 | 2254 | 2 | 26 | 1513 |
| Example 32 | 60 | 11.5 | 2049 | 1 | 27 | 1518 |
| Example 33 | 70 | 12.5 | 2367 | 1 | 27 | 1516 |
| Example 34 | 62 | 10.1 | 1587 | 2 | 34 | 1564 |
| Example 35 | 61 | 10.0 | 1540 | 2 | 33 | 1545 |
| Example 36 | 74 | 12.4 | 2154 | 1 | 27 | 1513 |
| Example 37 | 61 | 11.1 | 2107 | 3 | 25 | 1496 |
| Example 38 | 79 | 11.6 | 2303 | 1 | 26 | 1521 |
| Example 39 | 80 | 11.2 | 2255 | 2 | 28 | 1507 |

Note:
[1]Impact strength at room temperature.
[2]Measured at 900° C.

TABLE 3-2

| No. | Evaluation Results of Sample | | | | | |
|---|---|---|---|---|---|---|
| | Area Ratio of Eutectic (δ + NbC) (%) | RT Impact Strength[1] ($\times 10^4$ J/m$^2$) | Tool Life (cm) | Weight Loss by Oxidation[2] (mg/cm$^2$) | 0.2% Yield Strength[2] (MPa) | Thermal Fatigue Life (cycles) |
| Com. Ex. 1 | 54 | 9.0 | 2445 | 2 | 18 | 1438 |
| Com. Ex. 2 | 59 | 20.0 | 2225 | 3 | 19 | 1483 |
| Com. Ex. 3 | 65 | 22.6 | 2272 | 2 | 20 | 1464 |
| Com. Ex. 4 | 70 | 25.5 | 2333 | 3 | 21 | 1456 |
| Com. Ex. 5 | 75 | 21.2 | 2379 | 3 | 22 | 1525 |
| Com. Ex. 6 | 80 | 19.9 | 2410 | 4 | 23 | 1519 |
| Com. Ex. 7 | 83 | 17.5 | 2476 | 2 | 24 | 1424 |
| Com. Ex. 8 | 83 | 16.7 | 2519 | 3 | 23 | 1486 |
| Com. Ex. 9 | 84 | 15.5 | 2619 | 2 | 24 | 1417 |
| Com. Ex. 10 | 58 | 5.8 | 1087 | 1 | 20 | 1543 |
| Com. Ex. 11 | 54 | 6.4 | 2260 | 1 | 24 | 1498 |
| Com. Ex. 12 | 87 | 9.8 | 1763 | 1 | 29 | 1535 |
| Com. Ex. 13 | 69 | 5.5 | 2024 | 1 | 26 | 1526 |
| Com. Ex. 14 | 62 | 13.6 | 2270 | 1 | 27 | 1527 |
| Com. Ex. 15 | 63 | 8.7 | 1487 | 23 | 26 | 1503 |
| Com. Ex. 16 | 60 | 11.7 | 2180 | 2 | 25 | 1521 |
| Com. Ex. 17 | 71 | 13.1 | 2270 | 3 | 29 | 1537 |
| Com. Ex. 18 | 68 | 8.9 | 2519 | 3 | 27 | 1519 |
| Com. Ex. 19 | 70 | 6.5 | 2569 | 4 | 28 | 1534 |
| Com. Ex. 20 | 66 | 6.2 | 1287 | 1 | 27 | 1523 |
| Com. Ex. 21 | 73 | 14.5 | 2483 | 97 | 28 | 1477 |
| Com. Ex. 22 | 72 | 8.3 | 1421 | 1 | 27 | 1526 |
| Com. Ex. 23 | 64 | 4.5 | 1252 | 1 | 41 | 1558 |
| Com. Ex. 24 | 65 | 4.1 | 1387 | 1 | 42 | 1564 |
| Com. Ex. 25 | 43 | 3.8 | 1313 | 5 | 20 | 1462 |
| Com. Ex. 26 | 51 | 5.2 | 1432 | 2 | 22 | 1485 |
| Com. Ex. 27 | 95 | 7.4 | 2558 | 3 | 30 | 1530 |
| Com. Ex. 28 | 52 | 5.5 | 1403 | 1 | 24 | 1486 |
| Com. Ex. 29 | 82 | 8.6 | 2517 | 3 | 29 | 1511 |
| Com. Ex. 30 | 63 | 5.0 | 1344 | 1 | 26 | 1514 |
| Com. Ex. 31 | 0 | 8.2 | 615 | 2 | 17 | 1384 |

TABLE 3-2-continued

| No. | Evaluation Results of Sample | | | | | |
|---|---|---|---|---|---|---|
| | Area Ratio of Eutectic (δ + NbC) (%) | RT Impact Strength(1) ($\times 10^4$ J/m$^2$) | Tool Life (cm) | Weight Loss by Oxidation(2) (mg/cm$^2$) | 0.2% Yield Strength(2) (MPa) | Thermal Fatigue Life (cycles) |
| Com. Ex. 32 | 36 | 7.0 | 1104 | 1 | 24 | 1413 |
| Com. Ex. 33 | 45 | 5.5 | 2226 | 1 | 35 | 1512 |
| Com. Ex. 34 | 76 | 11.9 | 1853 | 1 | 33 | 1558 |

Note:
(1)Impact strength at room temperature.
(2)Measured at 900° C.

Example 40

The heat-resistant, ferritic cast steel of Example 18 was cast to form a turbine housing (main thickness: 4.0-6.0 mm) for automobiles, subject to a mold shakeout step in an as-cast state without heat treatment, a step of cutting off casting design portions (ingates), a cleaning step by shot blasting, and a finishing step of removing flash, etc., and then machined. The resultant turbine housing suffered neither cracking and fracture, nor casting defects such as shrinkage cavities, misrun, gas defects, etc. It was also free from machining trouble, the abnormal wear and damage of cutting tools, etc.

This turbine housing was assembled to an exhaust simulator corresponding to a high-performance, inline, four-cylinder gasoline engine with displacement of 2000 cc. To measure a life until penetrating cracks were generated, and how cracking and oxidation occurred, a durability test was conducted by repeating a cycle consisting of heating for 10 minutes and cooling for 10 minutes, under the conditions that the exhaust gas temperature under full load was about 1000° C. at an inlet of the turbine housing, and that the turbine housing had the highest surface temperature of about 950° C. and the lowest cooling temperature of about 80° C. at a wastegate (on the downstream side of an exhaust gas), with a temperature amplitude of about 870° C. The targeted number of heating/cooling cycles was 1200 cycles.

The durability test revealed that this turbine housing passed 1200 cycles of the durability test without suffering the leakage of an exhaust gas and cracking. Appearance inspection and penetrant inspection after the durability test revealed that the turbine housing suffered neither cracking nor fracture, much less penetrating cracking, in any portions including the wastegate, through which a high-temperature exhaust gas passes, and the thinnest scroll portion, with little oxidation on the entire surface. This confirmed that the turbine housing of the present invention had excellent oxidation resistance and thermal cracking resistance at about 900° C.

As described above, the exhaust members made of the heat-resistant, ferritic cast steel of the present invention had high heat resistance and durability at about 900° C., as well as excellent melt flowability, gas defect resistance, toughness and machinability. The exhaust members of the present invention made of the heat-resistant, ferritic cast steel containing small amounts of rare metals are inexpensive, and expand ranges to which fuel-efficiency-improving technologies are applicable to low-price automobiles, thereby contributing to reducing the amount of a $CO_2$ gas exhausted.

Though the exhaust members for automobile engines have been explained above, the applications of the heat-resistant, ferritic cast steel of the present invention are not restricted thereto, but may be used for various cast members required to have excellent heat resistance and durability such as oxidation resistance, thermal cracking resistance, thermal deformation resistance, etc., as well as melt flowability, gas defect resistance, toughness and machinability, for instance, combustion engines for construction machines, ships, aircrafts, etc., thermal equipments for melting furnaces, heat treatment furnaces, combustion furnaces, kilns, boilers, cogeneration facilities, etc., petrochemical plants, gas plants, thermal power generation plants, nuclear power plants, etc.

EFFECTS OF THE INVENTION

The heat-resistant, ferritic cast steel of the present invention has excellent melt flowability, gas defect resistance, toughness and machinability, as well as high heat resistance properties such as oxidation resistance, thermal cracking resistance, thermal deformation resistance, etc. at about 900° C., without a heat treatment. It also has economic advantages such as cost reduction by reducing the amounts of rare metals used, and stable supply of raw materials. Further, because of no necessity of heat treatment, the production cost can be reduced, contributing to reducing energy consumption.

The heat-resistant, ferritic cast steel of the present invention having such features is suitable for exhaust members of automobiles. Because such exhaust members are inexpensive and have excellent heat resistance properties, they contribute to improving fuel efficiency and reducing the emission of $CO_2$.

What is claimed is:

1. A heat-resistant, ferritic cast steel having excellent melt flowability, gas defect resistance, toughness and machinability, which has a composition comprising by mass C: 0.32-0.45%,
Si: 0.85% or less,
Mn: 0.15-2%,
Ni: 1.5% or less,
Cr: 16-23%,
Nb: 3.2-4.5%,
Nb/C: 9-11.5,
N: 0.15% or less,
S: (Nb/20−0.1) to 0.2%, and
W and/or Mo: 3.2% or less in total (W+Mo),
the balance being Fe and inevitable impurities, and a structure in which the area ratio of a eutectic (δ+NbC) phase of δ ferrite and Nb carbide (NbC) is 60-80%, and the area ratio of manganese chromium sulfide (MnCr)S is 0.2-1.2%.

2. An exhaust member made of the heat-resistant, ferritic cast steel recited in claim 1.

3. The heat-resistant, ferritic cast steel having excellent melt flowability, gas defect resistance, toughness and machinability, according to claim 1, wherein C content is 0.32-0.44%.

4. The heat-resistant, ferritic cast steel having excellent melt flowability, gas defect resistance, toughness and machinability, according to claim 1, wherein Nb content is 3.3-4.5%.

* * * * *